US008201297B2

(12) United States Patent
Fulmer

(10) Patent No.: US 8,201,297 B2
(45) Date of Patent: Jun. 19, 2012

(54) GROUT CLEANING DEVICE

(76) Inventor: R. Tracey Fulmer, Cape Coral, FL (US)

( * ) Notice: Subject to any disclaimer, the term of this patent is extended or adjusted under 35 U.S.C. 154(b) by 314 days.

(21) Appl. No.: 12/621,680

(22) Filed: Nov. 19, 2009

(65) Prior Publication Data

US 2011/0113574 A1 May 19, 2011

(51) Int. Cl.
*A47L 11/16* (2006.01)
*A47L 11/283* (2006.01)

(52) U.S. Cl. ..... 15/50.3; 15/29; 15/82; 15/98

(58) Field of Classification Search ..... 15/50.3, 15/52.1, 79.1, 82, 98, 29
See application file for complete search history.

(56) References Cited

U.S. PATENT DOCUMENTS

| | | | | |
|---|---|---|---|---|
| 5,423,102 | A | 6/1995 | Madison | |
| 7,114,211 | B2 | 10/2006 | Elster | |
| 8,028,365 | B2 * | 10/2011 | Field | 15/98 |
| 2004/0117931 | A1 | 6/2004 | Washington et al. | |
| 2007/0192987 | A1 * | 8/2007 | Garcia et al. | 15/339 |

* cited by examiner

*Primary Examiner* — Randall Chin
(74) *Attorney, Agent, or Firm* — Dale J. Ream

(57) ABSTRACT

A grout cleaning device includes a housing having a front end, a lower region, and a handle; the lower region being separated from the handle. The cleaning device includes a rotatable brush operatively coupled to the housing at the housing front end for scrubbing grout. A motor is located in the housing and operatively coupled to the brush for rotating the brush. An ultraviolet light is operatively coupled to the housing at the housing lower region for sanitizing grout.

7 Claims, 6 Drawing Sheets

GROUT CLEANING DEVICE

BACKGROUND OF THE INVENTION

This invention relates generally to cleaning devices and, more particularly, to a cleaning device especially suited for cleaning grout lines between tiles.

Cleaning floor surfaces can be a tiring and time consuming task that is dreaded by occupants of a residence. This task may be difficult not only because of repeatedly bending and standing but also due to the pattern or uneven character of the floor material. For example, cleaning tile is difficult because dirt or other refuse positioned in the grout lines in between adjacent tiles is hard to grasp, sweep, or otherwise remove. Even when dirt is swept or wiped from the grout, the grout surface may still not be truly sanitized from bacteria and viruses residing thereon.

Various devices have been proposed in the art for cleaning and scrubbing floor surfaces, including devices for scrubbing grout. Although assumably effective for their intended purposes, the existing devices do not include a battery powered brush having a reservoir for holding and dispensing cleaning solution as well as a UV light that sanitizes a cleaned surface. In addition, existing brush devices may not have a brush specifically configured for the shape of the space between tiles.

Therefore, it would be desirable to have a grout cleaning device having a brush that is configured to clean thoroughly between tiles. Further, it would be desirable for the brush to be movable when energized by battery power. In addition, it would be desirable to have a grout cleaning device having a UV light for sanitizing a surface after being cleaned by operation of the brush. An input such as a button or a switch is provided to selectively actuate the motor to operate the brush.

SUMMARY OF THE INVENTION

A grout cleaning device according to the present invention includes a housing having a front end, a lower region, and a handle; the lower region being separated from the handle. The cleaning device includes a rotatable brush operatively coupled to the housing at the housing front end for scrubbing grout. A motor is located in the housing and operatively coupled to the brush for rotating the brush. An ultraviolet light is operatively coupled to the housing at the housing lower region for sanitizing grout.

Therefore, a general object of this invention is to provide a grout cleaning tool having a battery powered brush for cleaning dirt from between adjacent tiles.

Another object of this invention is to provide a grout cleaning tool, as aforesaid, in which a battery powered motor is operatively connected to the brush.

Still another object of this invention is to provide a grout cleaning tool, as aforesaid, that includes an ultraviolet light for sanitizing a grout surface by killing bacteria and viruses.

Yet another object of this invention is to provide a grout cleaning tool, as aforesaid, that is easy to operate and cost-effective to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
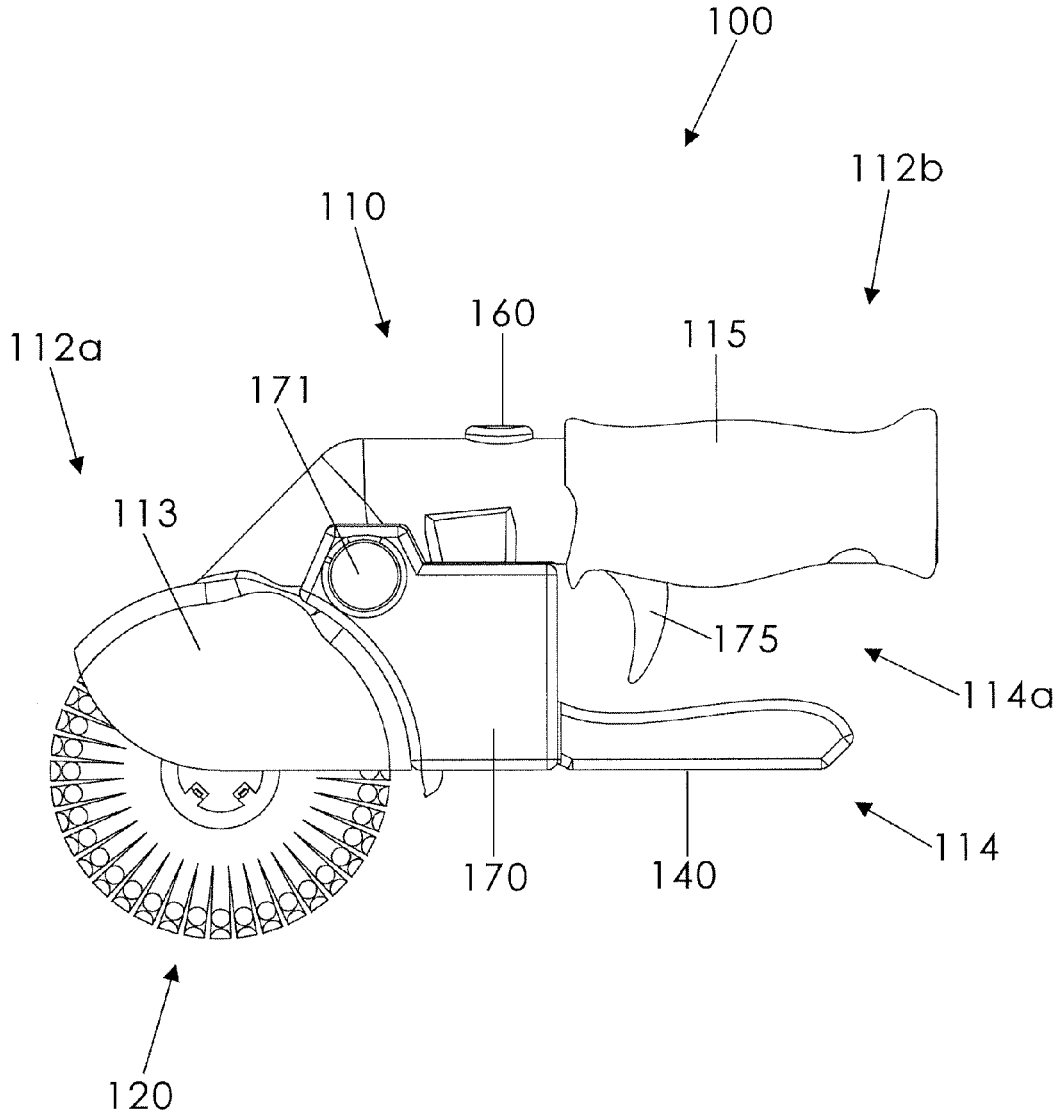
FIG. 1 is a side view of a grout cleaning device according to a preferred embodiment of the present invention.
Figure 2:
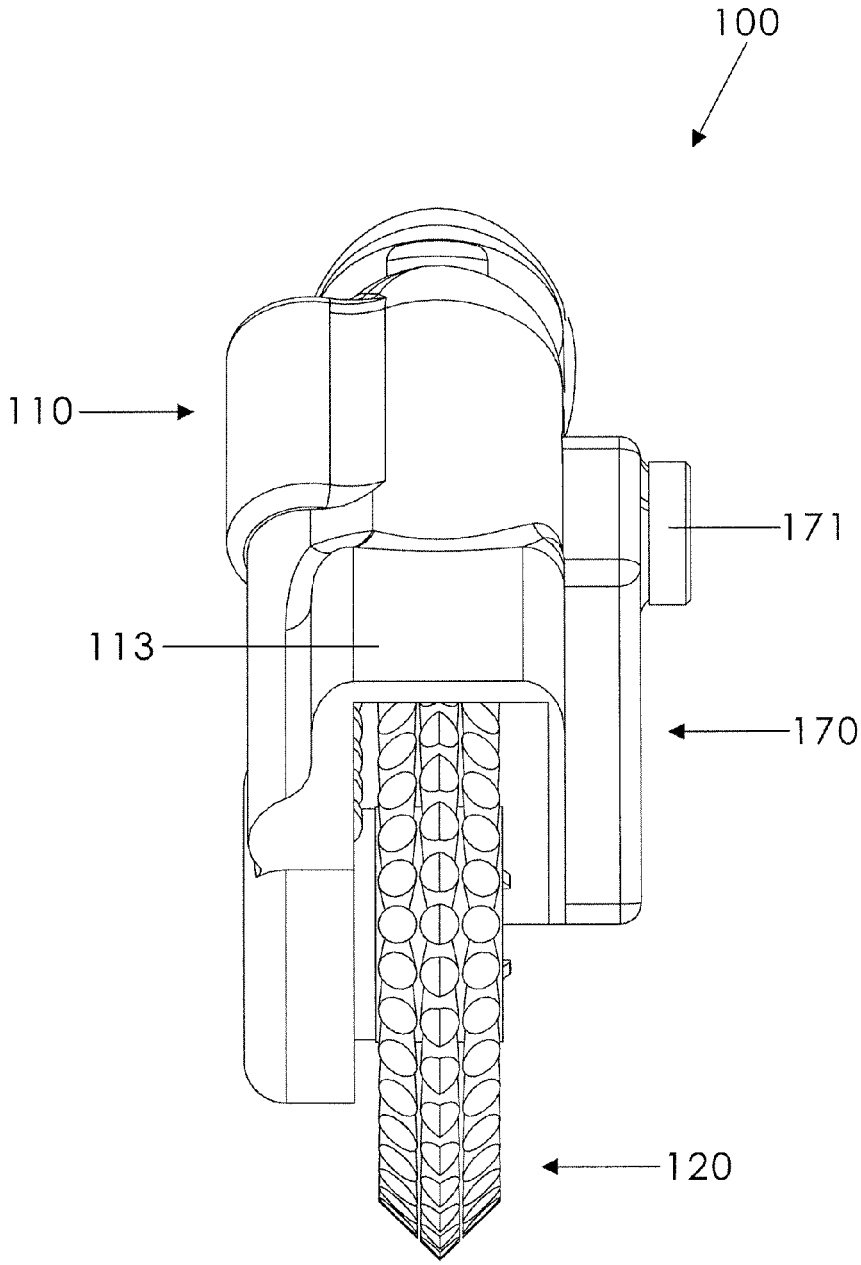
FIG. 2 is a front view of the grout cleaning device as in FIG. 1.
Figure 3:
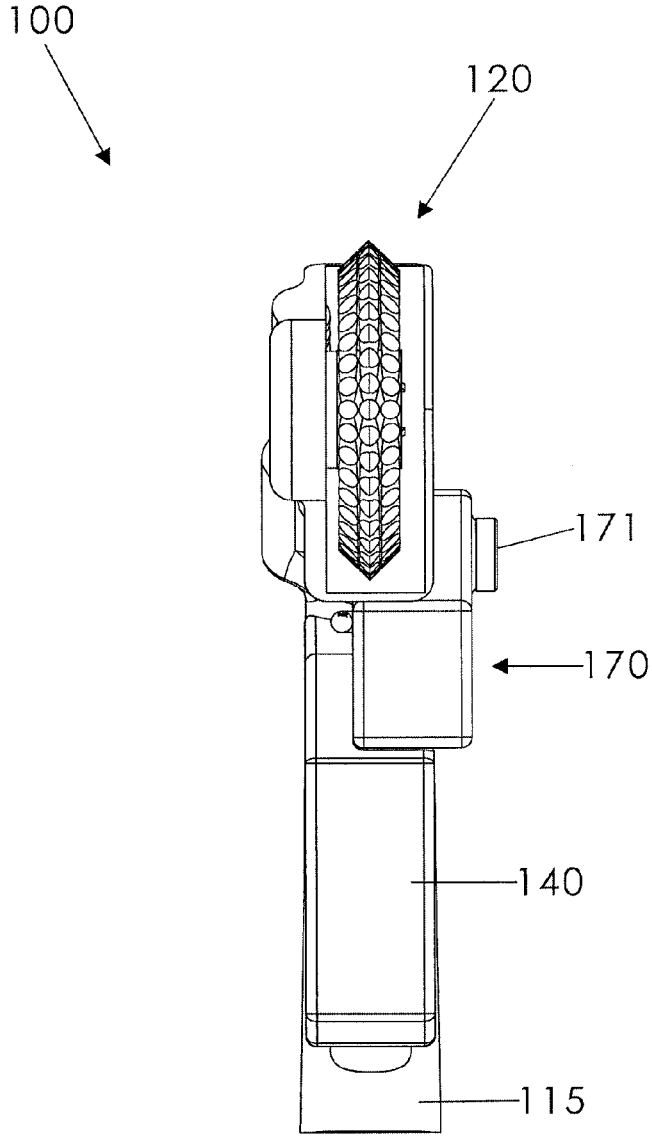
FIG. 3 is a bottom view of the grout cleaning device as in FIG. 1.
Figure 4:
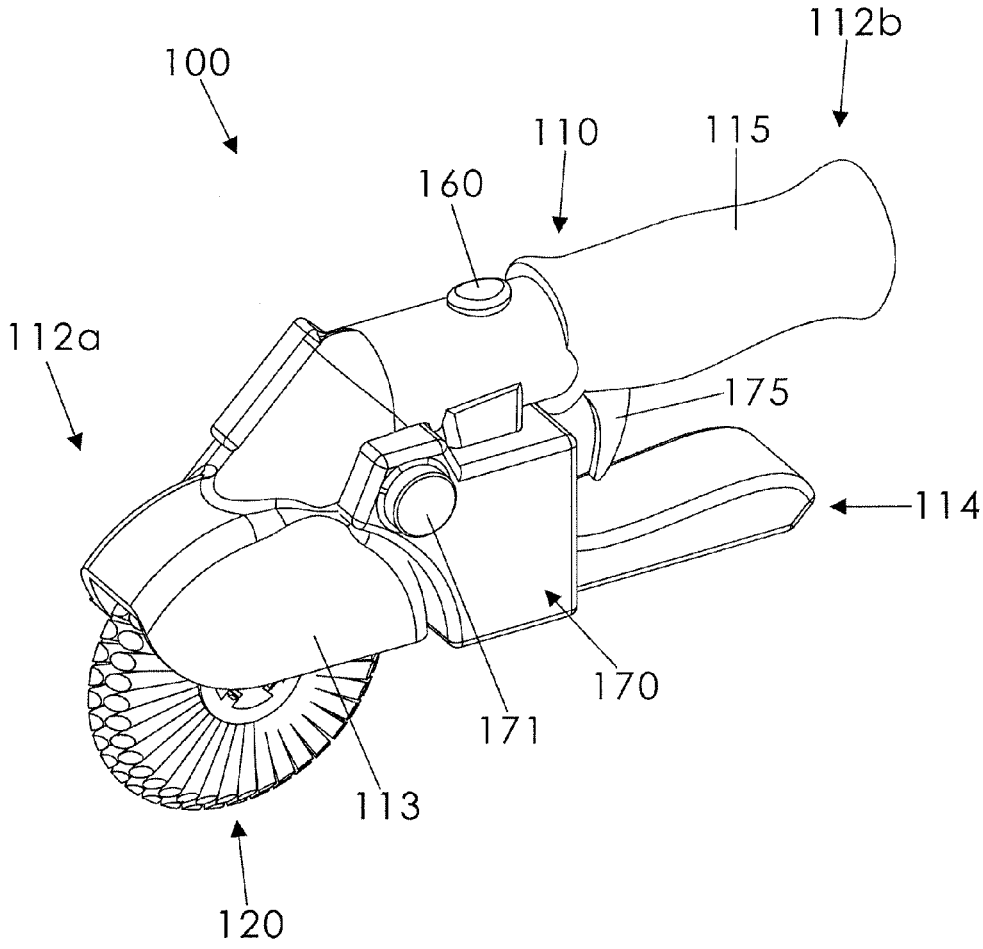
FIG. 4 is a perspective view of the grout cleaning device as in FIG. 1.

Grout cleaning devices according to the present invention will now be described in detail with reference to FIGS. 1 through 6 of the accompanying drawings. More particularly, a grout cleaning device 100 according to one embodiment includes a housing 110, a rotatable brush 120, a motor 130, and an ultraviolet light (also referred to herein as "UV light") 140.

As shown in FIG. 1, the housing 110 may have front and rear ends 112*a*, 112*b* and a lower region 114. The rear end 112*b* may include a handle 115, and the lower region 114 may be separated from the handle 115 by an open area 114*a* for receiving a user's fingers. While the housing 110 may be constructed of various materials (e.g., plastic, metal, etc.), it may be preferable for the housing 110 to be waterproof.

The rotatable brush 120 is operatively coupled to the housing 110 at the housing front end 112*a* for scrubbing grout (FIG. 1), and the housing front end 112*a* may include a splash guard 113 surrounding a portion of the brush 120. The brush 120 may have a V-shaped configuration such that a central portion of the brush 120 has a larger diameter than opposed edge portions of the brush 120 (FIG. 2), and the brush 120 may be constructed of a sponge material, a plurality of bristles, and/or any other appropriate material.

Figure 6:
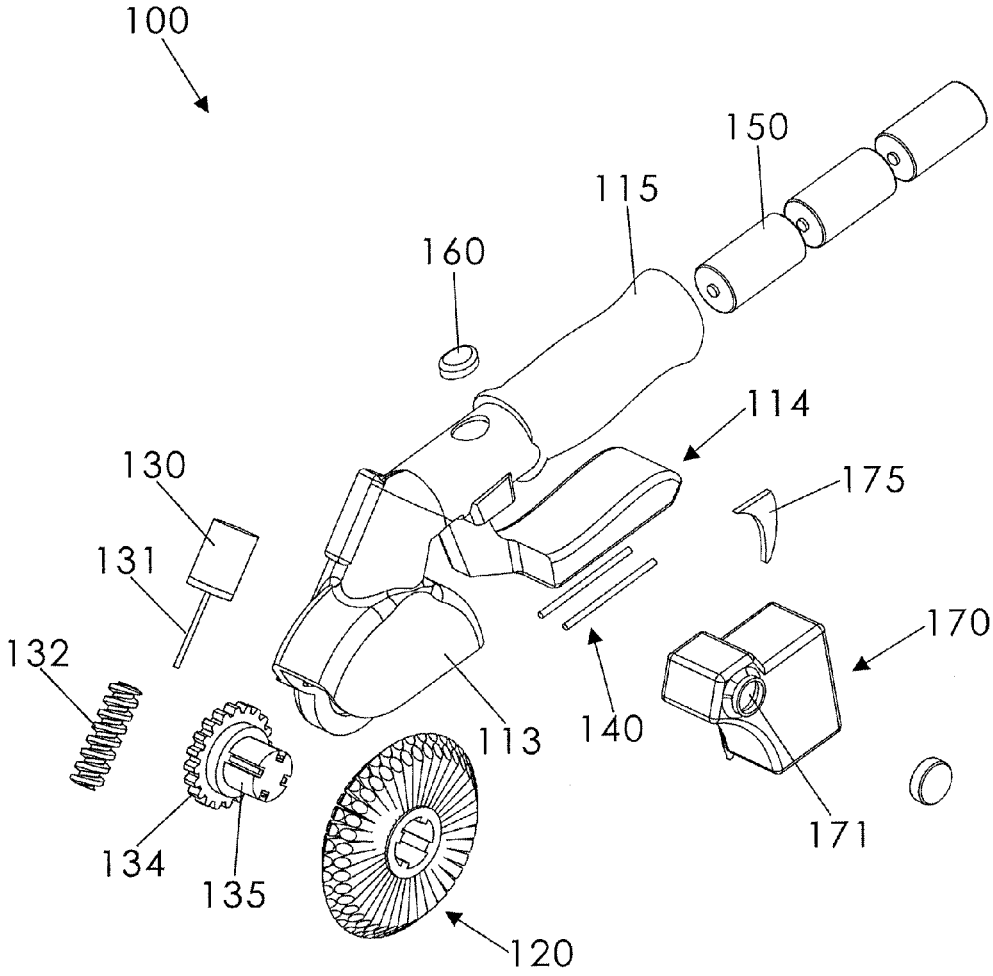
FIG. 6 is an exploded view of the grout cleaning device as in FIG. 4.

As shown in FIG. 6, the motor 130 is located in the housing 110 and operatively coupled to the brush 120 for rotating the brush 120. The motor 130 may be coupled to the brush 120 through various gearing and/or other transmitting devices. For example, as shown in FIG. 6, a worm gear 132 may be coupled to an output shaft 131 of the motor 130, and the worm gear 132 may interact with gearing 134 coupled to a hub 135 that mounts the brush 120.

The UV light 140 (FIG. 6) may be coupled to the housing 110 at the lower region 114 for sanitizing grout, and at least one battery 150 (FIG. 6) may be inside the housing 110 for powering the motor 130 and the UV light 140. In other embodiments, the motor 130 and the UV light 140 may be powered through an alternating current source.

Various means may be included for actuating the motor 130 and the UV light 140. For example, one or more input 160 (e.g., button, switch, etc.) may be in electrical communication with the power source (e.g., the battery 150) such that a user may selectively actuate the motor 130 and the UV light 140 (either jointly or individually).

Turning to FIG. 1 and FIG. 6, the grout cleaning device 100 may include a reservoir 170 for holding cleaning solution. In addition, means may be included for providing cleaning solution from the reservoir 170 to the brush 120. For example, various pumps, either manually or electrically operated, may be in communication with the reservoir 170. A switch (or "trigger") 175 in communication with the pump is shown in the drawings for actuating the pump to provide cleaning solution to the brush 120 (i.e., directly to the brush 120 or adjacent the brush 120). In one embodiment, the cleaning solution is provided inside the splash guard 113 to the brush 120.

Figure 5:
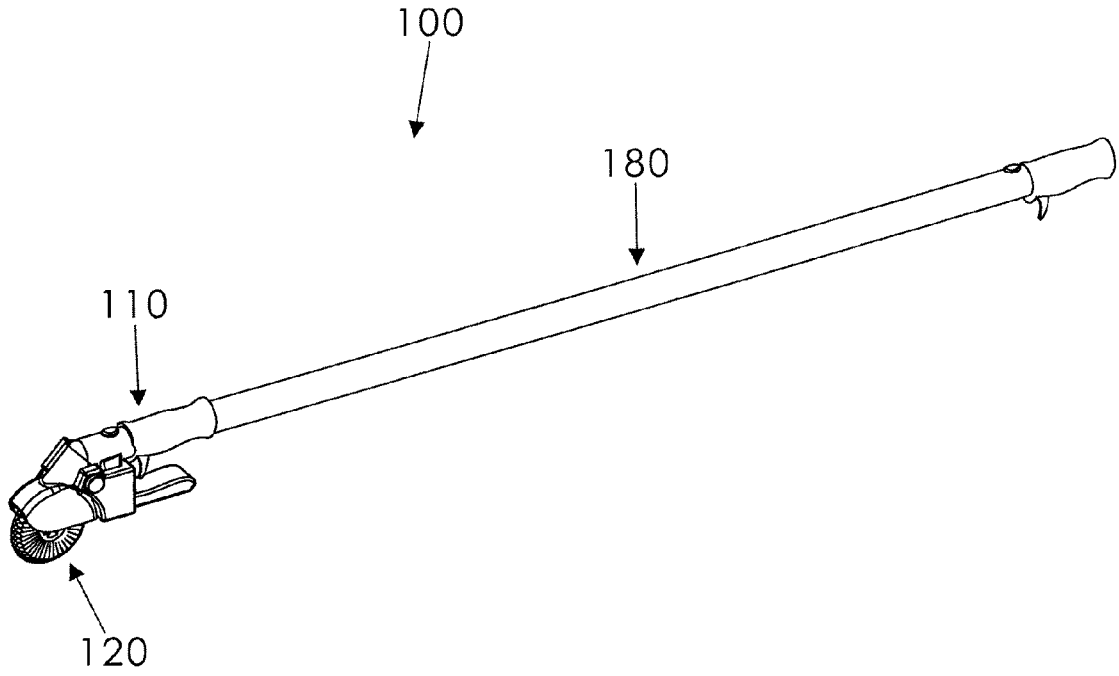
FIG. 5 is a perspective view of the grout cleaning device as in FIG. 1 in use with an extension device.

As shown in FIG. 5, an extension device 180 may be removably coupled to the housing 110 to allow the brush 120 and the UV light 140 to access an expanded area of grout from a stationary location. In other words, the extension device 180 may allow the user to easily reach additional areas. The extension device 180 may be telescoping and may attach to the housing 110 through any acceptable removable manner.

In use, the grout cleaning device 100 may be used to clean grout. More particularly, a user may place the brush 120 adjacent grout and actuate the motor 130 to spin the brush 120 and thereby clean the grout. The cleaning solution may be provided to the brush 120 from the reservoir 170 to further clean the grout, and the UV light 140 may be actuated to kill bacteria and viruses. The location of the UV light 140 such that it cleans the grout after the brush 120 and the cleaning fluid are used may allow the UV light 140 to be most effective. The splash guard 113 and the lower region 114 may keep the cleaning solution, bacteria, and viruses from contacting the user's hand, and by using the extension device 180, grout that would otherwise be difficult to reach may be easily accessed. Further, due to its V-shaped configuration, the brush 120 may be used in corner areas without trouble. When empty, the reservoir 170 may be refilled (i.e., through port 171).

It is understood that while certain forms of this invention have been illustrated and described, it is not limited thereto except insofar as such limitations are included in the following claims and allowable functional equivalents thereof.

The invention claimed is:

1. A grout cleaning device, comprising:

a housing having a front end, a lower region, and a handle; said lower region being separated from said handle;

a rotatable brush operatively coupled to said housing at said housing front end for scrubbing grout;

a motor operatively coupled to said brush for rotating said brush, said motor being located in said housing;

an ultraviolet light operatively coupled to said housing at said housing lower region for sanitizing grout;

means for actuating said motor and said ultraviolet light;

a reservoir for holding cleaning solution;

means for providing cleaning solution from said reservoir to said brush;

wherein said brush has a V-shaped configuration such that a central portion of said brush has a larger diameter than opposed edge portions of said brush;

wherein said lower region is separated from said handle by an open area for receiving a user's fingers.

2. The grout cleaning device of claim 1, wherein said housing front end includes a splash guard surrounding a portion of said brush.

3. The grout cleaning device of claim 2, wherein said means for providing cleaning solution provides said cleaning solution inside said splash guard to said brush.

4. The grout cleaning device of claim 3, further comprising an extension device removably coupled to said housing to allow said brush and said ultraviolet light to access an expanded area of grout from a stationary location.

5. The grout cleaning device of claim 4, wherein said housing is waterproof and a battery inside said housing powers said motor and said ultraviolet light.

6. The grout cleaning device of claim 1, wherein:

said lower region is separated from said handle by an open area for receiving a user's fingers;

said housing front end includes a splash guard surrounding a portion of said brush; and an extension device is removably coupled to said housing to allow said brush and said ultraviolet light to access an expanded area of grout from a stationary location.

7. A grout cleaning device, comprising:

a housing having a front end, a lower region, and a handle; said lower region being separated from said handle;

a rotatable brush operatively coupled to said housing at said housing front end for scrubbing grout;

a motor operatively coupled to said brush for rotating said brush, said motor being located in said housing;

an ultraviolet light operatively coupled to said housing at said housing lower region for sanitizing grout;

means for actuating said motor and said ultraviolet light;

wherein:

said lower region is separated from said handle by an open area for receiving a user's fingers;

said housing front end includes a splash guard surrounding a portion of said brush; and an extension device is removably coupled to said housing to allow said brush and said ultraviolet light to access an expanded area of grout from a stationary location.

* * * * *